United States Patent [19]

Petrick

[11] 4,274,202

[45] Jun. 23, 1981

[54] PERFORATING DEVICE

[75] Inventor: Detlef Petrick, Wermelskirchen, Fed. Rep. of Germany

[73] Assignee: Bonumwerke Tigges & Winckel GmbH & Co. KG, Velbert, Fed. Rep. of Germany

[21] Appl. No.: 162,734

[22] Filed: Jun. 25, 1980

[30] Foreign Application Priority Data

Jul. 9, 1979 [DE] Fed. Rep. of Germany ..... 2927677

[51] Int. Cl.[3] ..... B26F 1/00

[52] U.S. Cl. ..... 30/365; 30/366

[58] Field of Search ..... 30/365, 366, 319

[56] References Cited

U.S. PATENT DOCUMENTS

| | | | |
|---|---|---|---|
| 976,496 | 11/1910 | Reiser | 30/365 |
| 3,389,466 | 6/1968 | Parris | 30/366 |
| 3,514,854 | 6/1970 | Norfleet | 30/365 |

*Primary Examiner*—Jimmy C. Peters
*Assistant Examiner*—J. T. Zatarga
*Attorney, Agent, or Firm*—Michael J. Striker

[57] ABSTRACT

A perforating device for wallpaper pieces to be separated from a wall includes an elongated handle and a pair of elongated rollers supported on the handle for free rotation by means of a frame rigidly connected to the handle and carrying axles to support the rollers. Each of the rollers has a plurality of spikes on its periphery which are equally spaced from each other. The rollers are inclined to each other at an obtuse angle so that during the reciprocating motion of the device over the surface to be perforated the spikes will have respective components of movement lengthwise and inclined to the direction of reciprocation and perforate the wallpaper in form of elongated holes to thereby permit a solvent to penetrate through the holes and reach the rearside of the wallpaper.

10 Claims, 3 Drawing Figures

PERFORATING DEVICE

BACKGROUND OF THE INVENTION

The invention relates to a device for stripping certain types of wallpaper by perforating it by means of rotatable rollers supported on an elongated handle.

To facilitate stripping of wallpaper and particularly synthetic plastic or plastic-coated wallpaper from walls during renovation work the adhesive layer on the back side of the paper should be destroyed. In the known devices, for this purpose a plurality of holes are produced in the wall paper to be removed by a spiked roller which is rotatably mounted on an elongated handle, the axis of elongation of which is normal to the central axis of rotation of the roller. Holes of relatively small diameter are produced in the wallpaper upon rotation of this roller. Water applied to the wallpaper is to penetrate through these holes and soake the adhesive layer on the now accessible backside of the wallpaper. The adhesive layer should they soften as a result of this water penetration. In the known arrangements for perforating wallpaper the holes made by the spikes of the roller are, however, relatively small (almost pinpricks) so that water penetration through these holes and subsequent moistening and softening of the adhesive layer on the backside of the wallpaper are considerably limited. In order to overcome this problem one must repeat the perforating action many times to produce a sufficient number of holes in the wallpaper, which is of course time-consuming. Another known roller device is utilized for drawing pieces of carpet together to make a tight seam.

This device has an elongated handle and two groups, each composed of a plurality of freely rotative discs, mounted on two angularly positioned supporting shafts which are rigidly connected to the handle. The discs of each group are relatively thin discs which rotate about the shafts independently of one another and are provided with circumferentially spaced nubs adapted to draw adjacent pieces of carpets togehter upon lengthwise movement of the handle so that the edges of the pieces become located close together and can then be connected to form a tight seam. This device can not be used for perforating wallpaper since the independent rotation of the discs can not be adapted for producing a pattern of holes and since no penetrating action is possible due to the lade of spikes.

SUMMARY OF THE INVENTION

It is an object of the invention to provide an improved perforating device for wallpaper.

Another object of the invention is to provide a device which produces in wallpaper holes of a size sufficient to increase water penetration through the holes to the adhesive layer on the backside of wallpaper.

Still another object of the invention is to provide a perforating device which is easy to operate.

These and other object of the invention are attained by means of a perforating device comprising an elongated handle, supporting means on the handle, and a pair of rollers supported on the supporting means for free rotation. Each of the rollers is formed with a plurality of spikes on the periphery thereof and has and axis of elongation. The spikes are projecting radially with reference to the respective axis. The axes of elongation of both rollers are inclined to each other at an angle having its apex located intermediate the rollers.

Upon reciprocating movement of the device over wallpaper to be perforated the spikes will have respective components of movement lengthwise and inclined to the direction of reciprocation and will perforate the wallpaper in form of elongated holes through which liquid may subsequently reach the rearside of the wallpaper.

Thus, the formation of elongated slot-like holes eliminates the drawbacks of the prior art, since these elongated holes have a surface area many times greater than the "pin-prick" holes produced by the prior art and since this increase in the combined surface areas of the holes is achieved in a single movement (pass) of the device over the wallpaper.

The spikes are equally spaced on the periphery of each roller.

The angle between elongated axis of the spiked rollers may be obtuse and may be in the range 140°–170°.

The axis of elongation of the handle may be located in a plane passing through a bisector of said angle, this plane being normal to a surface to be perforated.

The angle between the axes of the rollers may be open toward the handle.

The spiked rollers may be hollow rollers. The supporting means may include a frame having an intermediate portion connected to the handle and two lateral portions and a pair of axles pivotally supported on the lateral portions, the hollow rollers being freely mounted on said axles.

The axles may extend to the apex of said angle.

The axes of elongation of the spiked rollers may be located in a common plane.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE INVENTION

Figure 1:
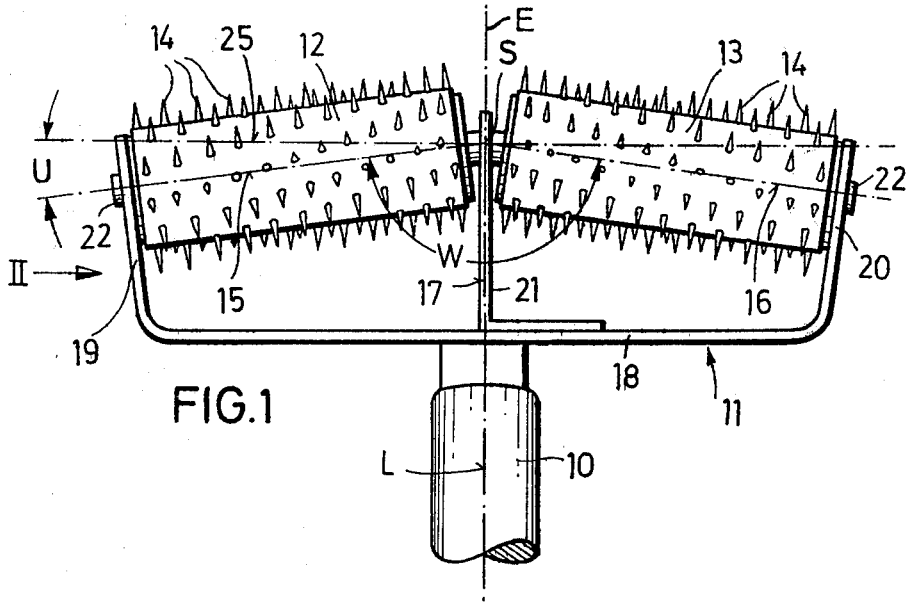
FIG. 1 is a top plan view of a perforating arrangement of the invention.

Referring to the drawings, the perforating arrangement for separating wallpaper pieces from each other according to the invention, includes an elongated handle 10 (shown in FIGS. 1 and 2, with a portion removed) which is rigidly connected to a support 11 formed as a frame-shaped element with two lateral portions 19 and 20 and an intermediate portion 18. The lateral portions 19 and 20 have mounted on them respective axles 22 and 22*a*, which each carry one of the unitary elongated spiked rollers 12 and 13. Each spiked roller has a body formed of brass or any other suitable material and a plurality of spikes 14 extending from this body in direction radially of the respective axle, i.e. projecting from an outer surface of the roller body. The spikes 14 may be made from steel or any other suitable material. The spikes 14 are positioned on the outer cylindrical surface of the rollers 12 and 13 in equally spaced relationship to each other.

Figure 2:
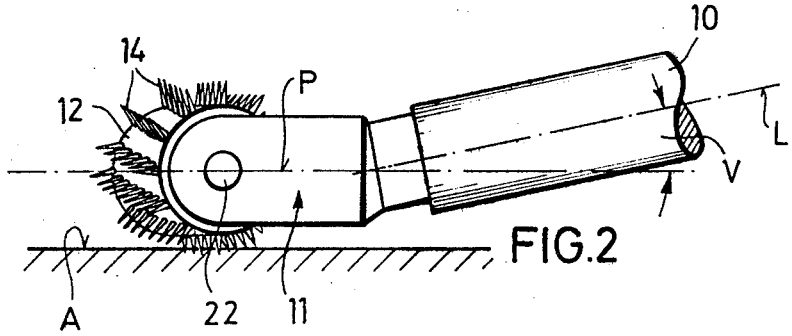
FIG. 2 is a side view of the arrangement illustrated as seen in the direction indicated by arrow II of FIG. 1.

As shown in FIG. 1, each spiked roller 12, 13 has an axis of elongation which are denoted as 15 and 16, respectively. The axes 15 and 16 are angularly disposed with respect to each other to include with each other an obtuse angle W which may lie in the range from 140° to 170°. An intersection of the axes 15 and 16 defines an apex S of the angle W which is located in longitudinal center plane E of the device, i.e. the plane which includes the longitudinal axis L of the handle 10 (shown in FIG. 2). The angle bisector 17 of angle W is also located in the plane E, so that the spiked rollers 12, 13 will be thereto to be inclined with respect to the plane E at equal but reversed angles. The support 11 is a frame-shaped member having an intermediate portion 18 affixed to the handle 10. An angled member 21 of an L-shaped form is rigidly connected to the intermediate portion 18 and has an elongated leg which is extended toward the apex S and projected beyond the latter between the two inclined axles 22 and **22*a*** whose inner ends it supports.

Figure 3:
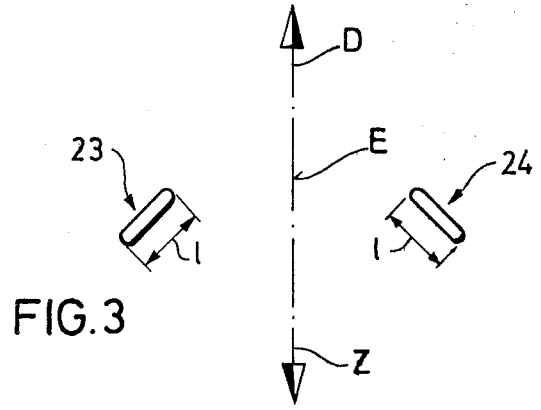
FIG. 3 is a schematic view showing a path of the arrangement of the invention during operation with respect to perforated holes being produced.

In operation, the handle 10 with the spiked rollers 12 and 13 is placed onto a surface A which is an outside of wallpaper to be perforated. The central axes 15 and 16 of the rollers are located in a common plane P which is parallel to the surface A. The axis of elongation L of the rod-shaped handle 10 is inclined to a plane P which is parallel to the surface A, at an angle V, whereby a relatively easy hand operation may be provided to easily move the handle 10 in two possible directions of movement in the plane E as shown in FIG. 3. The inclination of the handle 10 at the angle V to the surface being treated facilitates the possibility to provide a predetermined distance of the handle from the surface to be perforated whereby relatively uniform pressures may be applied to the surface A during operation.

FIG. 3 Schecmatically shows the mode of operation of the perforating arrangement due to the inclined position of the spiked rollers 12 and 13. The perforating arrangement is moved along the plane E in the direction shown by an arrow Z or in the direction of an arrow D over the surface of the wallpaper in such a manner that during the back and forth movement each individual spike 14 forms an elongated hole due to the fact that the rollers are inclined in the manner described, whereas the spikes extend radially of the respective axles, so that each spike has a component of movement transverse to the direction of arrows D and Z. However, since the holes being formed one forming symmetrically relative to plane E, the effects of these components on the movement of the roller tend to compensate one another, so that the movement of the device in direction of the arrows D or Z is no more difficult than with the conventional one-roller device where the roller's axis of rotation is strictly normal to the plane E.

The hole formed by the left spiked roller 12 is designated as 23, whereas the hole formed by the right spiked roller 13 is denoted as 24. The length 1 of the holes 23, 24 is defined by an angle U which depends on the magnitude of angle W; the angle U is the angle of inclination of the roller 12 with reference to the axis 25 defining a position of the roller in the known device. When the perforating device is moved in the direction of arrow Z over the outside of the wallpaper the elongated holes will be formed beginning from the top outwardly and then from the bottom inwardly to obtain the holes of desirable shape. When the handle 10 pulls the rollers 12 and 13 in the direction of arrow D, the formation of holes 23,24 is achieved by moving the rollers first from the bottom inwardly and then from the top upwardly. By reciprocating movement of the device back and forth along the plane E, the symmetrically positioned holes 23 and 24 extending transversely to the direction of movement indicated by Z or D may be produced when the spiked rollers engage with the surface being perforated. The above-described principle of operation of the perforating device substantially facilitates hand operation over the previously known devices for perforating wall paper.

It has been found that the device having angle W between the axes 15 and 16 of the spiked rollers 12 and 13 equal to 155° performs very satisfactory. After the elongated holes 23, 24 have been made, water as a solvent medium or any other suitable fluid or steam penetrates through these holes and covers the adhesive layer disposed on the backside of the wallpaper to moisten and soften the latter. The wallpaper may be thereafter easily removed from a wall.

In the above-described operation each individual spike engaging the surface of the wallpaper produces the elongated hole by reciprocating rolling motion of the handle 10 carrying the rollers 12 and 13. By one reciprocating motion an efficient perforation may be obtained to permit a relatively large amount of water to penetrate through the holes for moistening and softening the adhesive layer in the backside of the wallpaper.

It will be understood that each of the elements described above, or two or more together, may also find a useful application in other types of apparatus for the continuous production of perforating devices differing from the types described above.

While the invention has been illustrated and described as embodied in an apparatus for the continuous production of perforating device it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of piror art, fairly constitute essential characteristics of the generic of specific aspects of this invention.

I claim:

1. A device for perforating wallpaper to be stripped from a wall comprising an elongated handle; supporting means on said handle; a pair of elongated rollers mounted on said supporting means for free rotation about respective axes which include with one another an angle having an apex located intermediate said rollers and a plurality of spikes arranged on said rollers and projecting radially with reference to the respective axis so that, upon reciprocating movement of said device over wallpaper to be perforated said spikes will have respective components of movement lengthwise and inclined to the direction of reciprocation and thus perforate the wallpaper in form of elongated holes through which liquid may subsequently reach the rearside of the wallpaper.

2. The device of claim 1, wherein said spikes are equally spaced on the periphery of each roller.

3. The device of claim 1, wherein said angle is obtuse.

4. The device of claim 3, wherein said angle is in the range 140°–170°.

5. The device of claim 3, wherein the axis of elongation of said handle is located in a plane passing through the bisector of said obtuse angle, said plane being normal to a surfce of the wallpaper to be perforated.

6. The device of claim 5, wherein said angle is open toward said handle.

7. The device of claim 6, wherein said rollers are hollow rollers.

8. The device of claim 7, wherein said supporting means include a frame having an intermediate portion connected to said handle and two lateral portions, and a pair of axles supported on said lateral portions, said hollow rollers being freely mounted on said axles.

9. The device of claim 8, wherein said axles extend toward the apex of said angle.

10. The device of claim 1, wherein said axes of elongation of said rollers are located in a common plane.

* * * * *